US010413963B2

(12) United States Patent
Maritz et al.

(10) Patent No.: US 10,413,963 B2
(45) Date of Patent: Sep. 17, 2019

(54) RING ROLLING DEVICE

(71) Applicant: Hatebur Umformmaschinen AG, Reinach (CH)

(72) Inventors: Andreas Maritz, Liestal (CH); Wolfgang Müller, Kleines Wiesental (DE); Pascal Stemmelin, Moernach (FR); Thomas Christoffel, Wittnau (CH)

(73) Assignee: Hatebur Umformmaschinen AG, Reinach (CH)

( * ) Notice: Subject to any disclaimer, the term of this patent is extended or adjusted under 35 U.S.C. 154(b) by 239 days.

(21) Appl. No.: 15/119,250

(22) PCT Filed: Feb. 25, 2014

(86) PCT No.: PCT/EP2014/053655
§ 371 (c)(1),
(2) Date: Aug. 16, 2016

(87) PCT Pub. No.: WO2015/127964
PCT Pub. Date: Sep. 3, 2015

(65) Prior Publication Data

US 2017/0008066 A1 Jan. 12, 2017

(51) Int. Cl.
*B21H 1/12* (2006.01)
*B21H 1/06* (2006.01)
*B21B 25/00* (2006.01)

(52) U.S. Cl.
CPC ..... *B21H 1/12* (2013.01); *B21B 25/00* (2013.01); *B21H 1/06* (2013.01)

(58) Field of Classification Search
CPC .... B21H 1/06; B21H 1/12; B21B 5/00; B21B 25/00
See application file for complete search history.

(56) References Cited

U.S. PATENT DOCUMENTS 3,288,542 A 11/1966 Cowles et al.
3,345,845 A 10/1967 Marcovitch et al.
(Continued)

FOREIGN PATENT DOCUMENTS

DE 627721 3/1936
DE 703436 3/1941
(Continued)

*Primary Examiner* — Debra M Sullivan
(74) *Attorney, Agent, or Firm* — The Webb Law Firm

(57) ABSTRACT

A ring rolling device includes a drive roller and a rotatable revolving drum, in which five mandrels are rotatably mounted. Ring blanks can be mounted around the mandrels. By rotating the revolver drum, the mandrels move towards and away from the drive roller. The revolver drum is arranged in relation to the drive roller such that by rotating the revolver drum a decreasing roll gap is formed between a mandrel approaching the drive roller and the drive roller, in which roll gap a ring blank mounted around the mandrel is rolled during the rotating of the revolver drum. The revolver drum has four rotatably mounted support rollers, said support rollers supporting the mandrel in the direction of the rotational axis of the revolving drum, such that, during the rolling process, the mandrel is located between the support rollers and the press element.

19 Claims, 8 Drawing Sheets

(56) References Cited

U.S. PATENT DOCUMENTS

| | | | | | |
|---|---|---|---|---|---|
| 3,469,427 | A | * | 9/1969 | Rollins | B21H 1/12<br>72/110 |
| 3,498,095 | A | * | 3/1970 | Marcovitch | B21H 1/12<br>72/106 |
| 4,173,877 | A | | 11/1979 | Kreiskorte | |
| 4,326,397 | A | | 4/1982 | Strugala et al. | |

FOREIGN PATENT DOCUMENTS

| | | | |
|---|---|---|---|
| DE | 1098481 | A | 2/1961 |
| DE | 1141970 | B | 1/1963 |
| DE | 1286497 | B | 1/1969 |
| DE | 1525291 | A1 | 9/1969 |
| DE | 3741006 | C2 | 6/1989 |
| DE | 4135906 | A1 | 5/1993 |
| DE | 4214861 | B4 | 11/1993 |
| DE | 1972506 | U | 11/1997 |
| GB | 1196874 | | 7/1968 |
| GB | 2047590 | A | 12/1980 |
| JP | 4425225 | Y1 | 10/1969 |
| JP | 53125961 | A | 11/1978 |
| JP | 62244541 | A | 10/1987 |
| JP | 6104258 | B2 | 12/1994 |
| JP | 2008302402 | A | 12/2008 |

* cited by examiner

RING ROLLING DEVICE

CROSS-REFERENCE TO RELATED APPLICATION

This application is the United States national phase of International Application No. PCT/EP2014/053655 filed Feb. 25, 2014, the disclosure of which is hereby incorporated in its entirety by reference.

BACKGROUND OF THE INVENTION

Field of the Invention

The present invention concerns a ring rolling device.

Description of Related Art

One known variant for the manufacturing of rings, for example for ball bearings, is to initially forge a ring blank, which is then further processed by ring rolling. To roll a ring, the ring blank is mounted around a mandrel and then rolled between the mandrel and a forming roller. In doing so, the thickness of the ring blank is reduced and, because no material is removed, its circumference is simultaneously increased. To reduce the thickness of the ring blank, the roll gap between the mandrel and the forming roller has to be continuously decreased, which can be accomplished, for example, by a displacement of the mandrel toward the forming roller or vice versa.

In a ring rolling device disclosed in U.S. Pat. No. 4,173,877 A, the forming roller is configured in such a way that, going out from a starting zone, its radius increases continuously against the direction of rotation of the roller. Thus, by rotating the forming roller with a constant distance of the mandrel, the roll gap is continuously decreased during the rolling process, as a result of which the ring blank is rolled to a smaller thickness. In this ring rolling device, four mandrels are mounted on a rotary table so that, by rotating the rotary table 90°, the next respective mandrel with the next ring blank previously disposed around it is rotated toward the forming roller into the rolling position. This rotation takes place precisely when the starting zone of the forming roller is facing the rotary table, where the ring blank does not yet come into contact with the forming roller. The ring blank is not rolled until after that has occurred, by rotating the forming roller while the rotary table has stopped rotating.

One disadvantage of this ring rolling device lies in that it requires a specially shaped forming roller. In addition, the rolling of the ring blank has to occur during exactly one revolution of the forming roller, and the next ring blank has to be brought into the rolling position at exactly the right time by a coordinated rotation of the rotary table.

DE 703 436 C discloses a ring rolling device comprising a roller as the press element and a rotary table with a plurality of mandrels rotatably mounted therein, around which the ring blanks that are to be rolled are mounted. By rotating the rotary table, the mandrels can be moved toward the press element and away from it again. In this way, a roll gap, which decreases in size and in which the ring blank is rolled, is formed between the mandrel and the press element. The mandrels each engage at the bottom in a conical bore in a mandrel roller pin rotatably mounted in the rotary table and are each firmly connected at the top to a second mandrel roller pin.

The disadvantages of this ring rolling device are the relatively imprecise mounting of the mandrels, which leads to rolling inaccuracies, and the large, relatively heavy rotary table, which slows down the operation.

SUMMARY OF THE INVENTION

Therefore, an object of the present invention is to provide a ring rolling device of the type mentioned at the beginning, which allows a fast and exact feeding and rolling of ring blanks.

The nature of the invention lies in the following: A ring rolling device for enlarging a ring blank comprises a press element, a rotatably mounted mandrel around which the ring blank can be mounted, and a rotatable revolver drum, in which the mandrel is rotatably mounted. The mandrel can be moved toward and away from the press element by rotating the revolver drum. The revolver drum is disposed relative to the press element such that, by rotating the revolver drum, a decreasing roll gap is formed between the mandrel and the press element, in which the ring blank is rolled during rotation of the revolver drum. According to the invention, the revolver drum comprises at least two rotatably mounted support rollers for the rotatable mounting of the mandrel, which support the mandrel in the direction of the rotation axis of the revolver drum, so that the mandrel is situated between the support rollers and the press element during the rolling process.

The ring rolling device according to the invention has the advantage that both the delivery of the ring blank to the rolling position and the rolling of the ring blank are effected by the rotation of the revolver drum toward the press element. By means of this rotation, a roll gap is first formed and the ring blank is brought into contact with the press element. The roll gap is subsequently reduced, as a result of which the ring blank is rolled between the mandrel and the press element, i.e. the wall thickness of the ring blank is reduced.

The at least two rotatably mounted support rollers allow a supporting of the mandrel during the rolling process to absorb the rolling forces along a desired length of the mandrel, as well as a rotation of the mandrel about its mandrel rotation axis during the rolling process. Good rolling precision can be achieved in this way. The mandrel also only has to be placed on the support rollers, which can be done very quickly.

The rotation axes of the mandrel and the support rollers, as well as the rotation axis of the revolver drum and, if the press element is a drive roller, the rotation axis of the press element are preferably parallel, but this is not absolutely necessary.

In the ring rolling device according to the invention, the revolver drum preferably comprises two spaced, disc-like drum parts, which are torsionally rigidly connected to one another, in each of which a part of the mandrel is rotatably mounted, so that a middle part of the mandrel between the two disc-like drum parts is exposed for mounting a ring blank. By means of the two disc-like drum parts, which are torsionally rigidly connected to one another, the mandrel can be mounted in a stable and at the same time rotatable manner on both sides of the middle part holding the ring blank.

In an advantageous design variant, the disc-like drum parts each comprise at least two rotatably mounted support rollers for the rotatable mounting of the mandrel, which support the mandrel in the direction of the rotation axis of the revolver drum, so that the mandrel is situated between the support rollers and the press element during the rolling process. The at least two support rollers allow a supporting of the mandrel on both sides of the middle part to absorb the rolling forces along a desired length of the mandrel, as well as a rotation of the mandrel about its mandrel rotation axis during the rolling process.

Advantageously, each support roller comprises a support flange for supporting the mandrel. The mandrel then rests only on the support flanges, which allows a simpler placement.

The respective support flanges are preferably disposed at one end of the support rollers and serve as lateral guides for the ring blank. The ring blank can thus be stabilized during the rolling process without additional components.

In another advantageous design variant, the mandrel in the revolver drum is rotatably mounted in at least one rolling bearing. Rolling bearings also allow a good supporting of the mandrel to absorb the rolling forces along a desired length of the mandrel, as well as a rotation of the mandrel about its mandrel rotation axis during the rolling process.

Rolling bearings and support rollers can also be combined with one another. It is in particular possible to provide a rolling bearing on the one side of the mandrel and support rollers on the other side.

The revolver drum preferably comprises a stop for positioning the mandrel in the longitudinal direction of the mandrel. This allows an exact positioning of the mandrel and the ring blank disposed upon it for the rolling process, and is of particular significance when the mandrel and/or the press element has/have a profile that is to be transferred to the ring blank.

Advantageously, the ring rolling device according to the invention comprises a mandrel adjuster for adjusting the mandrel in the longitudinal direction of the mandrel. By pulling back the mandrel, delivering a ring blank to a loading position, pushing the mandrel forward again and pushing the mandrel through the ring blank in the loading position, it is thus possible to arrange or mount this ring blank easily around the mandrel. Conversely, with the same or another mandrel adjuster, the finished rolled ring can be removed from the mandrel by pulling the mandrel back.

The ring rolling device according to the invention preferably comprises a ring blank feed mechanism, with which ring blanks can be fed individually to a location at which the mandrel can be pushed through the fed ring blank, i.e. the abovementioned loading position. Together with the mandrel adjuster, this allows a ring blank to be easily mounted or arranged around the mandrel.

Advantageously, several mandrels are rotatably mounted in the revolver drum. Different processes can in this way take place at different stations at the same time. For example, a ring blank can be mounted around a mandrel at a first station, a ring blank can be rolled at a second station, and a ring blank can be removed from a mandrel at a third station. The rolling throughput can thus be increased considerably, i.e. more ring blanks can be rolled into rings in less time.

By virtue of the higher rolling throughput, ring rolling can take place in phase with the production of ring blanks, and the ring rolling device can, for example, be attached to a cold-forming or a hot-forming machine. With attachment to a hot-forming machine, it is possible to exploit the advantage that the still hot ring blanks produced by the hot-forming machine can be rolled directly with the ring rolling device. Additional heating of the ring blanks for hot ring rolling can thus be dispensed with. In principle, however, heating of the ring blanks prior to ring rolling is possible, and ring rolling devices according to the invention can be used both for hot ring rolling and cold ring rolling.

In hot ring rolling, a cooling of the components of the rolling device, e.g. mandrel, press element, drive roller, etc., may optionally be provided.

Preferably, the ring rolling device according to the invention comprises a drive mechanism for driving the press, so that the ring blank can be rotated by the movement of the press element during the rolling process. This makes it possible to rotate the ring blank several times on the rotatably mounted mandrel during the rolling process with the aid of the press element, wherein in each rotation the ring blank is rolled to a lesser thickness. In this way, it is possible to achieve a greater reduction of thickness, and a more uniform rolling that is gentler on the material. Depending on the size of the ring blank and on the desired reduction of the wall thickness, it has proven particularly advantageous for the ring blank to be rotated three to thirty times, in particular eight to twelve times, during the rolling process.

Advantageously, the press element is a rotatably mounted drive roller. Such a drive roller can be driven continuously, for example by means of a motor, and can transmit its rotational movement to the ring blank mounted around the mandrel as soon as the ring blank comes into contact with the drive roller. Compared to a linear press element, which would also be conceivable in the ring rolling device according to the invention, the rotation of the drive roller can be continuous and have a constant speed, and the press element does not have to be reset after the rolling process.

BRIEF DESCRIPTION OF THE DRAWINGS

The ring rolling device according to the invention is described in more detail in the following with reference to illustrative embodiments and with the aid of the attached drawings. The figures show.

Figure 1:
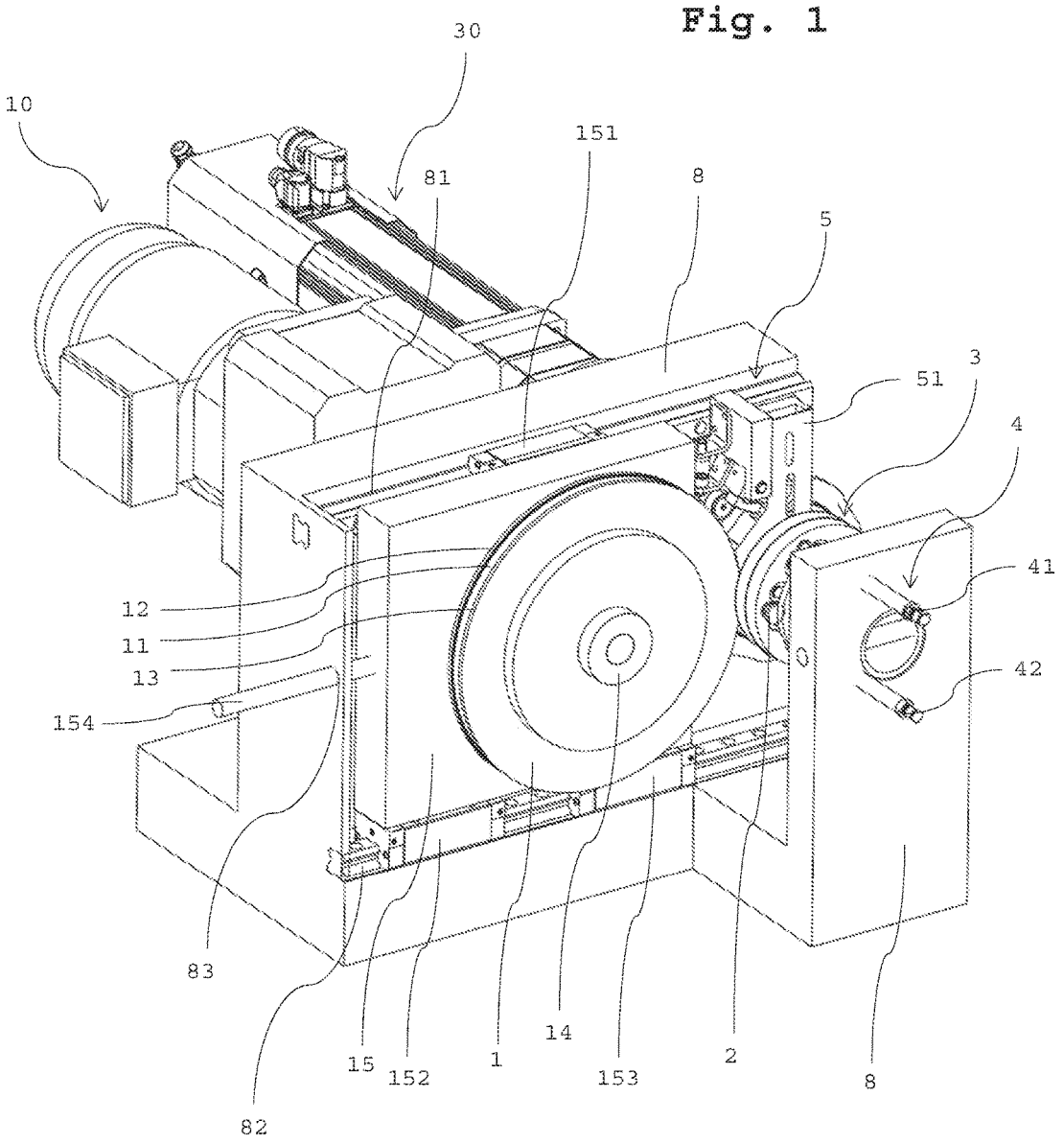
FIG. 1—a perspective view of an illustrative embodiment of a ring rolling device according to the invention.

The following applies to the description below: If, in order to avoid ambiguity in the drawing, a figure contains reference signs which are not mentioned in the directly associated part of the description, reference is made to the location in which these are explained in previous or following parts of the description. Conversely, to avoid overcomplicating the drawing, reference signs that are less relevant to a direct understanding are not included in all figures. In that case, reference is made to the respective other figures.

DESCRIPTION OF THE INVENTION

Figure 2:
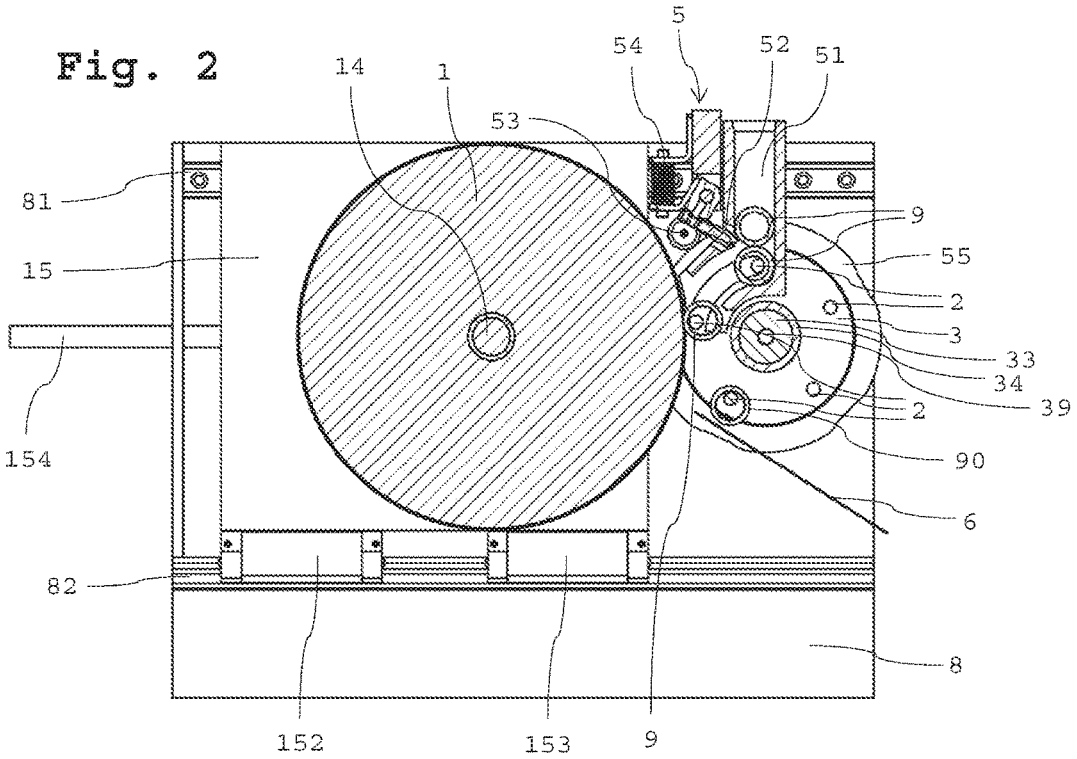
FIG. 2—a section through the ring rolling device of FIG. 1, shortly prior to rolling a ring blank.

The illustrative embodiment of a ring rolling device according to the invention shown in FIGS. 1 and 2 comprises a drive roller 1 as the press element, which, on its circumference, has a rolling surface 11 that is limited on both sides by a collar 12, 13. As can best be seen in FIGS. 9 and 10, the collars 12, 13 prevent a lateral expansion of the ring blank 9 during the ring rolling process. The drive roller 1 is rotatably mounted on a bearing plate 15 via a shaft 14 and is driven by means of a drive mechanism 10.

Via three rail grip elements 151, 152 and 153, for example, the top and the bottom of the bearing plate 15 is respectively mounted on a rail 81 and 82, in such a way that the bearing plate can be moved in the direction of a rotation axis 39 of the revolver drum. The rails are in turn firmly anchored in a machine frame 8. By means of an adjustment spindle 154, the bearing plate 15, and with it the drive roller 1 mounted thereon, can be shifted in the direction of the roll gap, wherein the size of the roll gap at its narrowest point can be set. For this purpose, the adjustment spindle 154 comprises an outer thread for example, which engages in an inner thread in a passage 83 through the machine frame 8, through which passage the adjustment spindle 154 is disposed.

In ring rolling, the ring blank 9 is rolled between the drive roller 1 and a mandrel 2 that is rotatably mounted in a revolver drum 3. It can be seen in FIG. 2, that five mandrels 2 are uniformly distributed, at an angular interval of 72° with respect to the rotation axis 39 of the revolver drum, and rotatably mounted in the present revolver drum 3. The revolver drum 3 is rotatably mounted on the machine frame 8 via a shaft 33 and is rotated by means of a drive mechanism 30, for example an electrical drive or servo motor.

To feed ring blanks 9 to the mandrels 2 in the revolver drum 3, the shown ring rolling device comprises a ring blank feed mechanism 5. The ring blank feed mechanism 5 is designed to feed ring blanks 9 individually to a location at which a mandrel 2 can be pushed through the delivered ring blank 9, i.e. a loading position. The ring blank feed mechanism 5 comprises a storage well 51, in which multiple ring blanks 9 can be stored. At its lower end, the storage well 51 is provided with an opening through which, due to gravity, a ring blank 9 passes directly into the loading position. To prevent ring blanks 9 from falling in the direction of the loading position in an uncontrolled manner, there is an articulated retention element 52, which by means of a spring element 54 acting on a cam roller 53 is held in a retention position, in which it holds the ring blanks 9 in the storage well 51. To release an individual ring blank 9, a control cam 55 rotatably disposed about the rotation axis 39 of the revolver drum simply acts on the cam roller 53 against the spring force.

To be able to mount a ring blank 9 around a mandrel 2 and later remove a rolled ring 90 from the mandrel 2, the ring rolling device comprises a mandrel adjuster 4 for adjusting the mandrel 2 in the longitudinal direction of the mandrel 2. Since the mounting of the ring blank 9 around the mandrel 2 and the removal of the rolled ring 90 from the mandrel 2 take place at two different locations, namely on the one hand directly underneath the storage well 51 and on the other hand after a rotation of the revolver drum 3 by approximately 150°, the mandrel adjuster 4 comprises two separate adjusting cylinders 41 and 42, which are secured on the machine frame 8.

To carry away the rolled ring 90 after its removal from the mandrel 2, an outlet channel 6 is disposed underneath the ring removal location in the shown ring rolling device.

Figure 3:
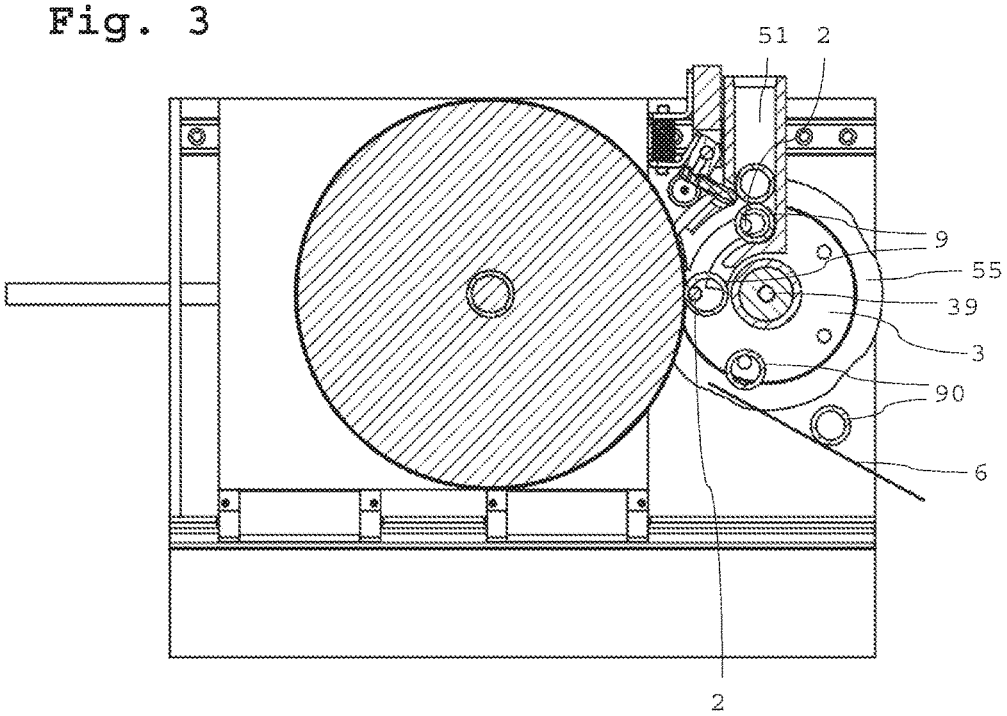
FIG. 3—a section through the ring rolling device of FIG. 1 analogous to FIG. 2, but during the rolling of a ring blank.

FIG. 3 largely corresponds to FIG. 2. The only difference is that the revolver drum 3 in FIG. 3 is rotated about 10° further counterclockwise than in FIG. 2.

In FIG. 2, a first ring blank 9 is in the loading position directly underneath the storage well 51, and a first mandrel 2 is being pushed through this first ring blank 9. A second ring blank 9, mounted around a second mandrel 2 at an angular distance of 72° from the first mandrel 2, is about to be in contact with the drive roller 1, i.e. has not yet been rolled.

To arrive at the situation shown in FIG. 3, the revolver drum 3 is rotated approximately 10° counterclockwise. For the time being, the first ring blank 9 remains in the loading position directly underneath the storage well 51, but it can be seen that the first mandrel 2 has rotated approximately 10° and now rests against the left-hand inner face of the first ring blank 9 so that, upon further rotation, it will carry the ring blank with it.

By the rotation of the revolver drum 3 and as a result of the reduction in the size of the roll gap between the second mandrel 2 and the drive roller 1, the second ring blank 9 has come into contact with the drive roller and has been rolled to a lesser thickness. Through contact with the drive roller 1, which preferably turns at a constant speed and is driven by the drive mechanism 10, a torque is transmitted to the ring blank 9, so that, together with the rotatably mounted second mandrel 2, the ring blank is made to rotate about the rotation axis of the mandrel, i.e. its central axis. Depending on the size of the ring blank and on the desired reduction of the wall thickness, it has proven particularly advantageous for the ring blank to be rotated three to thirty times, in particular eight to twelve times, preferably about ten times, during the rolling process. To achieve this, the rotational speeds of the drive roller 1 and the revolver drum 3 are suitably selected. Rotating the ring blank 9 several times during the ring rolling process permits a greater reduction of thickness and a more uniform rolling, which is gentler on the material.

Figure 4:
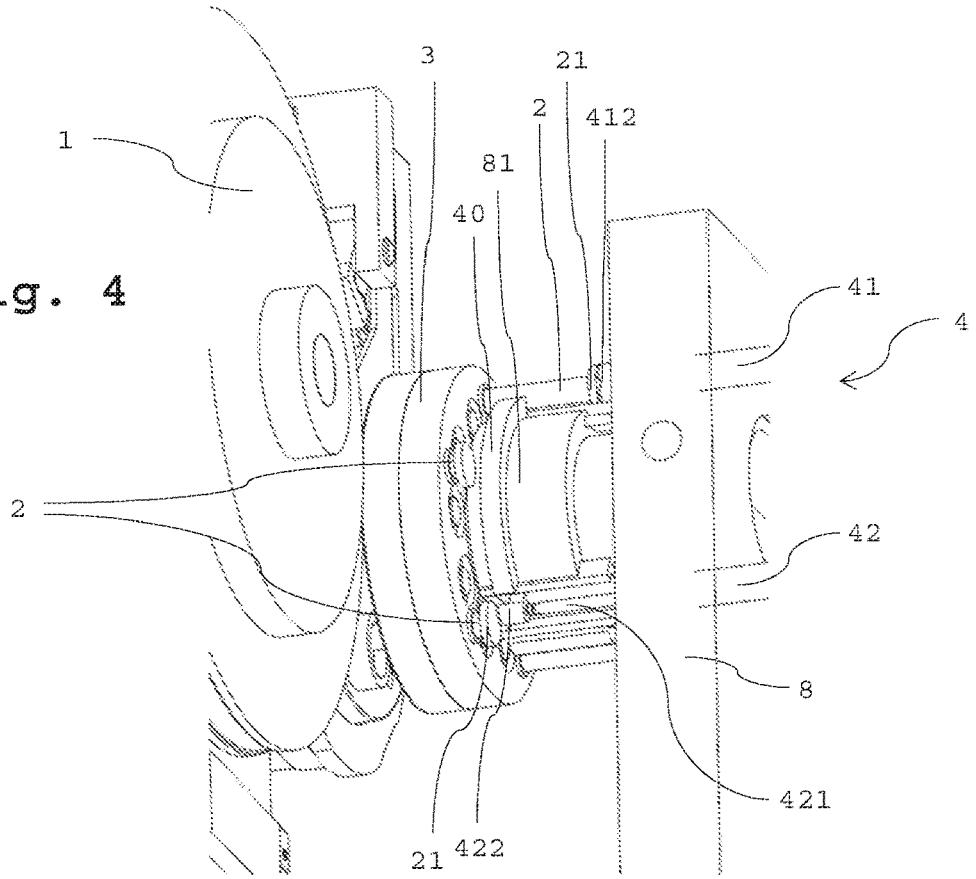
FIGS. 4-6—different perspective detail views of parts of the ring rolling device of FIG. 1.
Figure 5:
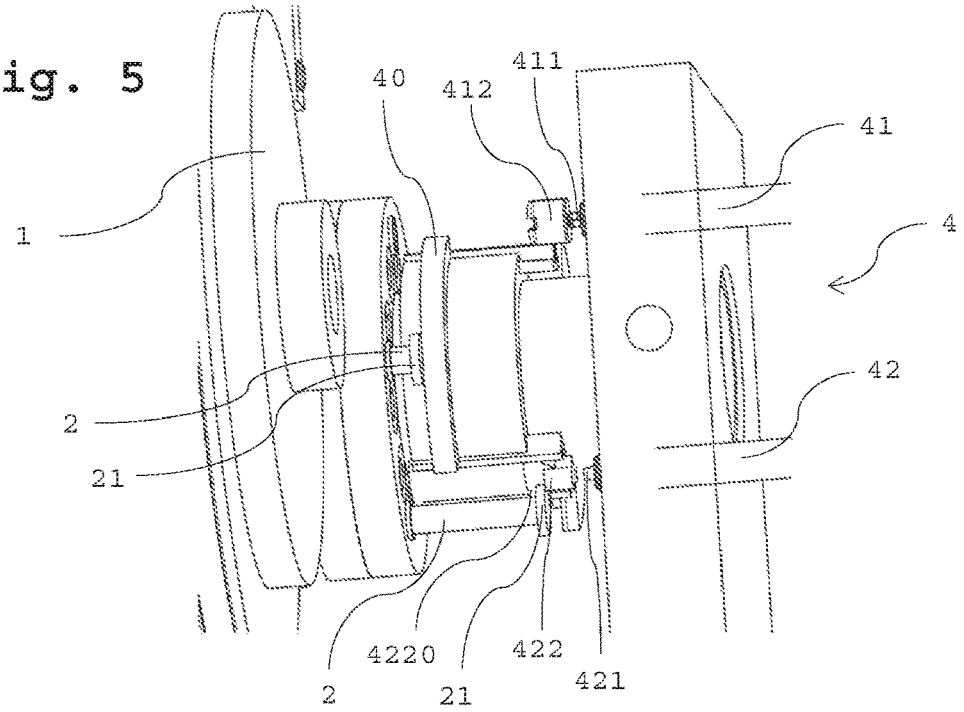

The mandrel adjuster 4 is shown in greater detail in FIGS. 4 and 5. As already described above, the mandrel adjuster 4 comprises two separate adjusting cylinders 41 and 42, which are secured on the machine frame 8. The adjusting cylinder 41 comprises an extendable piston 411, on which a thrust head 412 is secured. In the situation shown in FIG. 4, the thrust head 412 pushes against a head 21 of the mandrel 2 thus, upon extension of the piston 411, pushing the mandrel 2 in the longitudinal direction of the mandrel into the revolver drum 3, where it is pushed through a ring blank 9 located in the loading position.

The adjusting cylinder 42 comprises an extendable piston 421 on which a gripper head 422 is secured. In the situations shown in FIGS. 4 and 5, the gripper head 422 engages behind the mandrel head 21 of a further mandrel 2 and, upon retraction of the piston 411, pulls this mandrel 2 in the longitudinal direction of the mandrel out of the revolver drum 3 and thus also out of the ring 90 that has been rolled to completion in this position of the revolver drum. In FIG. 4, the mandrel 2 is still in the starting position in the revolver drum 3, whereas in FIG. 5 it has been driven partially out of the revolver drum 3. The engagement of the gripper head 422 behind the mandrel head 21 is effected by the rotation of the revolver drum 3, as a result of which the mandrel head 21 is pushed over a gripper part 4220 of the gripper head 422. This gripper part 4220 can best be seen in FIG. 6.

To ensure that the mandrel 2 is not inadvertently moved back out of the revolver drum 3 during the rotation of the revolver drum 3 in counterclockwise direction, the ring rolling device comprises a hold-down means 40, which is secured in a flange-like manner around a mounting pipe 81 secured on the machine frame 8. This hold-down means 40 forms a stop for the mandrel head 21, as can best be seen in FIG. 5.

Figure 6:
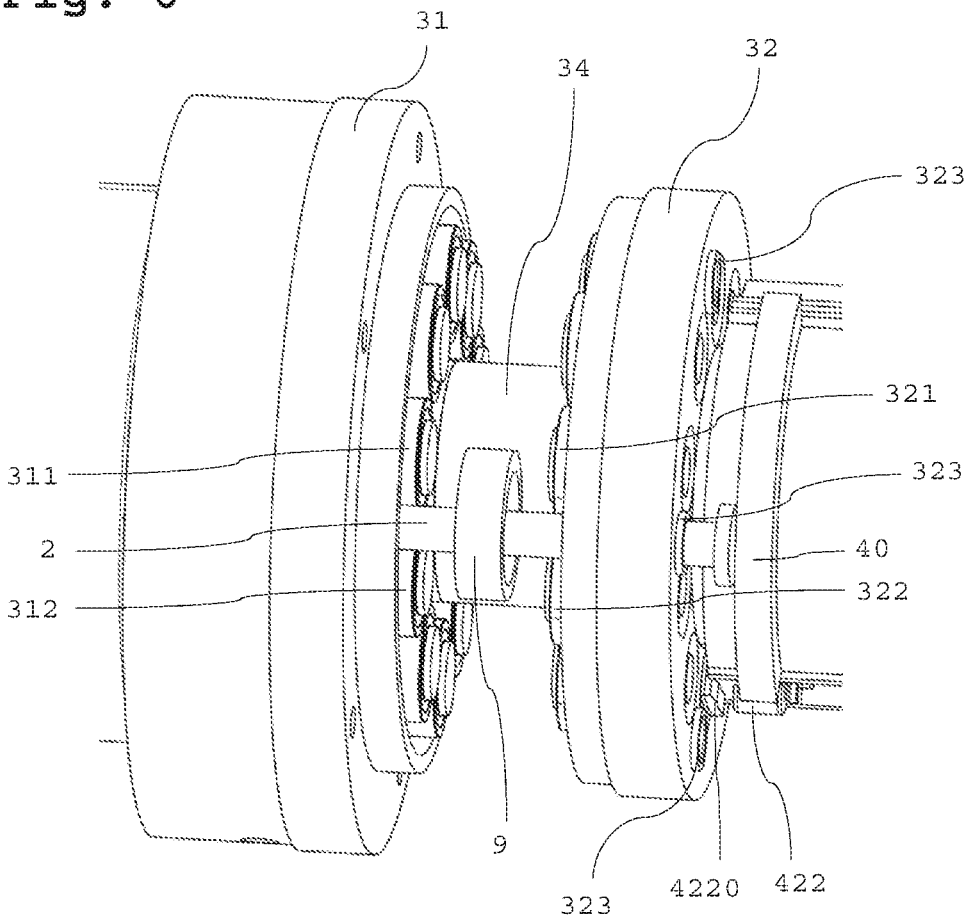

It can be seen from FIG. 6, that the revolver drum 3 in the shown illustrative embodiment comprises two spaced, disc-like drum parts 31 and 32, which are torsionally rigidly connected to one another via a shaft 33 (see FIG. 2) and in each of which a part of the mandrel 2 is rotatably mounted, so that a middle part of the mandrel 2, around which a ring blank 9 is mounted, is exposed between the two disc-like drum parts 31, 32. A spacer 34 is disposed between the two disc-like drum parts 31, 32 and fixes the distance between the drum parts. In the drum part 32, there are five mandrel passages 323 for the mandrels 2 arranged at an angular distance of 72°.

For the rotatable mounting of the mandrels 2, the disc-like drum parts 31, 32 each comprise at least two rotatably mounted support rollers 311, 312 or 321, 322 per mandrel 2. These support rollers 311, 312, 321, 322 support the respective mandrel 2 in the direction of the rotation axis 39 of the revolver drum, so that the mandrel 2 is situated between the support rollers 311, 312, 321, 322 and the drive roller 1 during the rolling process.

Figure 7:
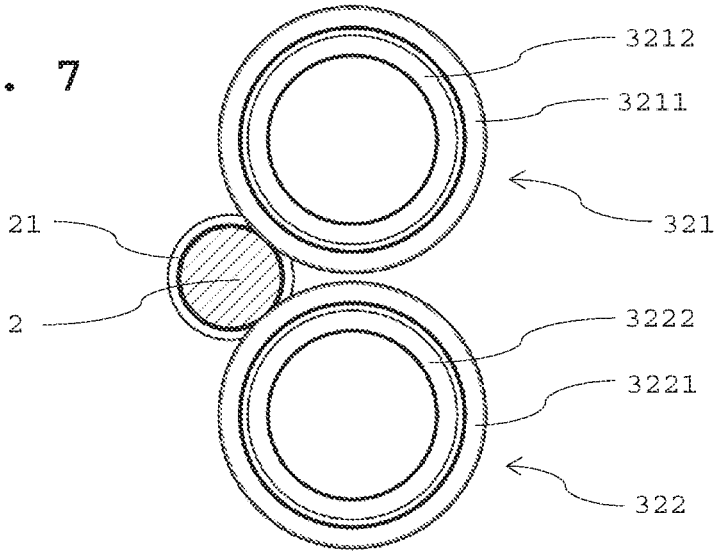
FIG. 7—a sectional view of a mandrel and two support rollers of the ring rolling device of FIG. 1.

FIG. 7 shows a sectional view of a mandrel 2 with a mandrel head 21, which is supported by two support rollers 321, 322. It can be seen that the support rollers 321, 322, and also the support rollers 311, 312 not shown here, are configured as rolling bearings with internal rollers 3212 and 3222 and external rollers 3211 and 3221. As can be seen from FIGS. 6 and 7, the support rollers 321, 322 are intermediate of the mandrel 2 and the rotation axis 39 of the revolver drum 3 (FIG. 2).

Figure 8:
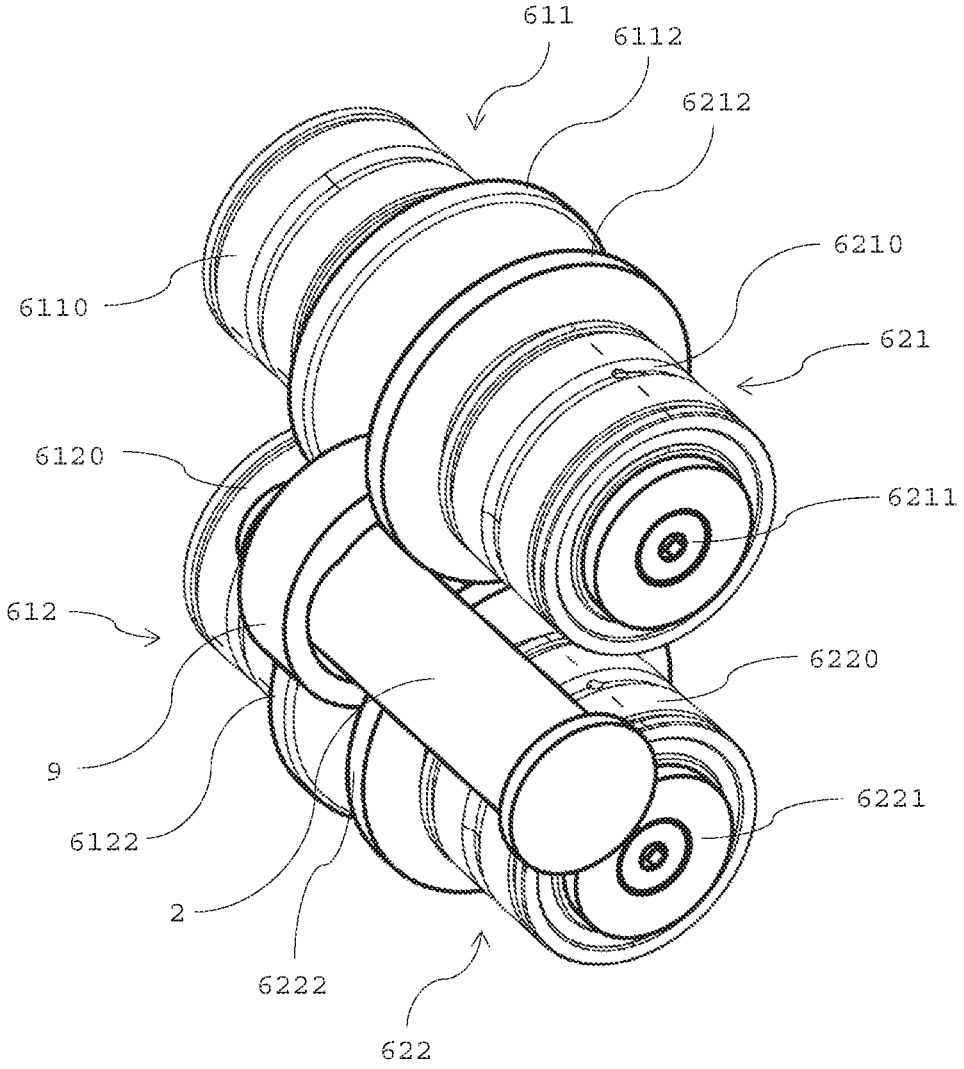
FIG. 8—a second illustrative embodiment of four support rollers supporting a mandrel.
Figure 9:
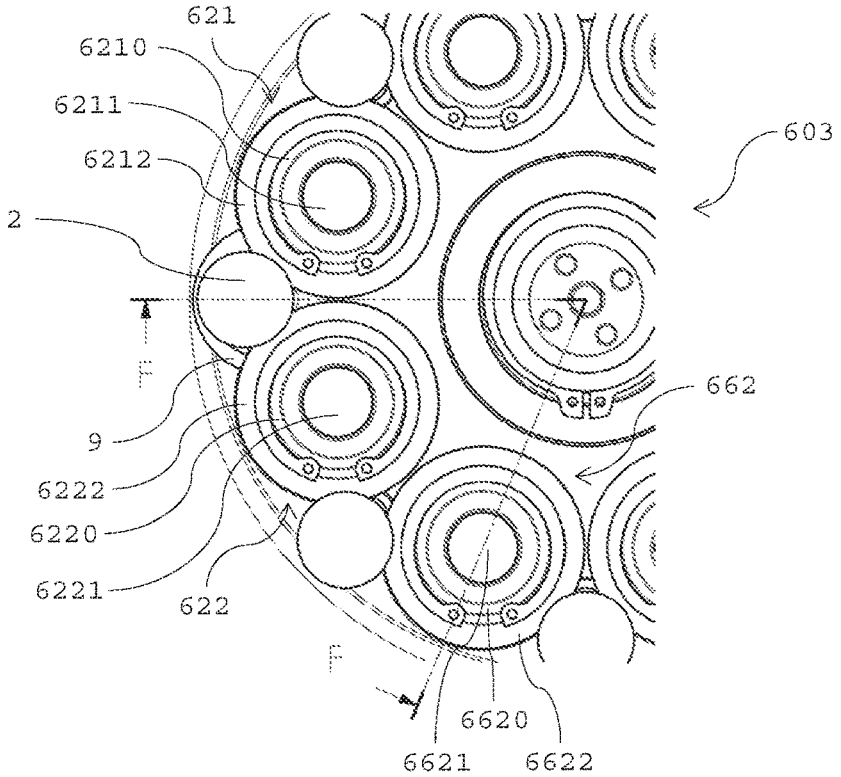
FIG. 9—support rollers and mandrels according to FIG. 8 in a revolver drum.
Figure 10:
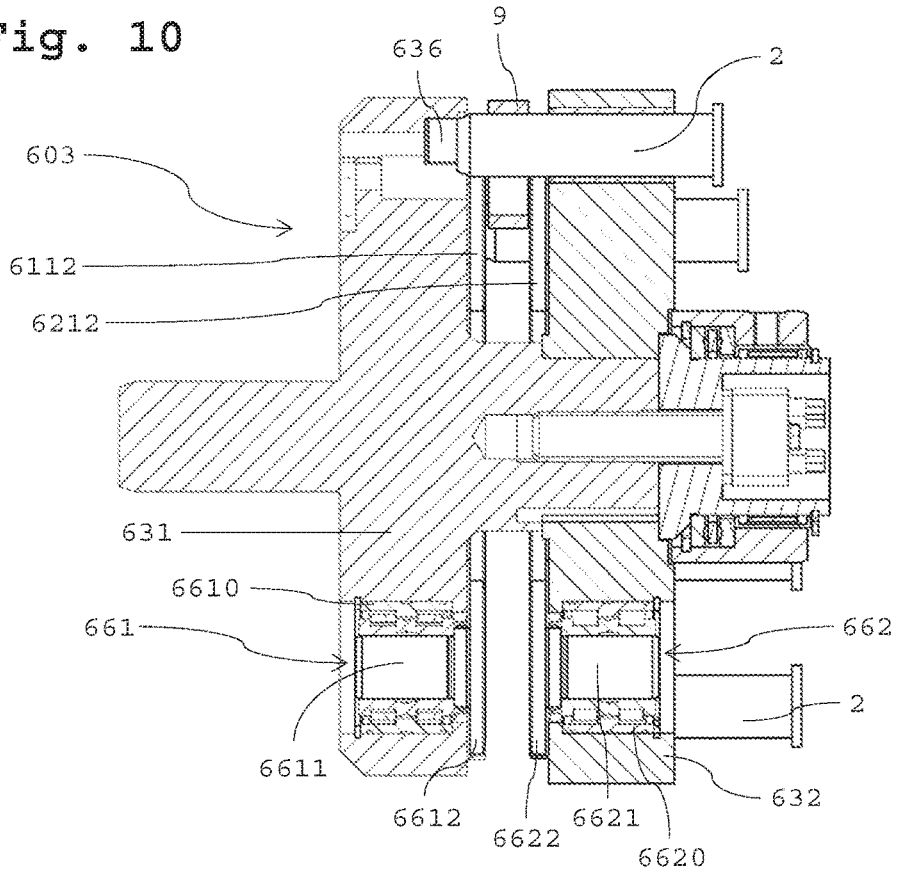
FIG. 10—a section along the line F-F in FIG. 9.

FIGS. 8 to 10 show a second illustrative embodiment of the ring rolling device in which each time four support rollers support one mandrel.

FIG. 8 is a perspective view of four support rollers 611, 612, 621, 622 supporting a mandrel 2 on which a ring blank 9 is disposed. Each support roller 611, 612, 621, 622 comprises an outer bearing part 6110, 6120, 6210, 6220, which is fixedly connected to the revolver drum, and a therein rotatably disposed inner roller 6111, 6121, 6211, 6221, which on its end facing the support roller lying across from it is provided with a support flange 6112, 6122, 6212, 6222 for supporting the mandrel 2. It can be seen that the support flanges 6112, 6122, 6212, 6222 serve as lateral guides for the ring blank 9.

In FIGS. 9 and 10, the support rollers 611, 612, 621, 622 and additional support rollers 661 and 662 are disposed in a revolver drum 603, wherein FIG. 10 shows a section along the line F-F in FIG. 9. The revolver drum 603 comprises two spaced, disc-like drum parts 631, 632, which are torsionally rigidly connected to one another, in each of which a part of each mandrel 2 is rotatably mounted.

In the lower part of FIG. 10 it can be seen that the support rollers 661, 662 each comprise an outer bearing part 6610, 6620 that is fixedly connected to the drum part 631 or 632.

Inner rollers 6611, 6621 are rotatably disposed in the interior of the outer bearing parts 6610, 6620 in a rolling bearing-like manner. On their end facing the support roller lying across from them, the inner rollers 6611, 6621 are provided with support flanges 6612, 6622.

From the upper part of FIG. 10 it can be seen how the mandrel 2 is supported by the support flanges 6112 and 6212. A stop 636 for the one end of the mandrel 2 is disposed in the drum part 631.

Figure 11:
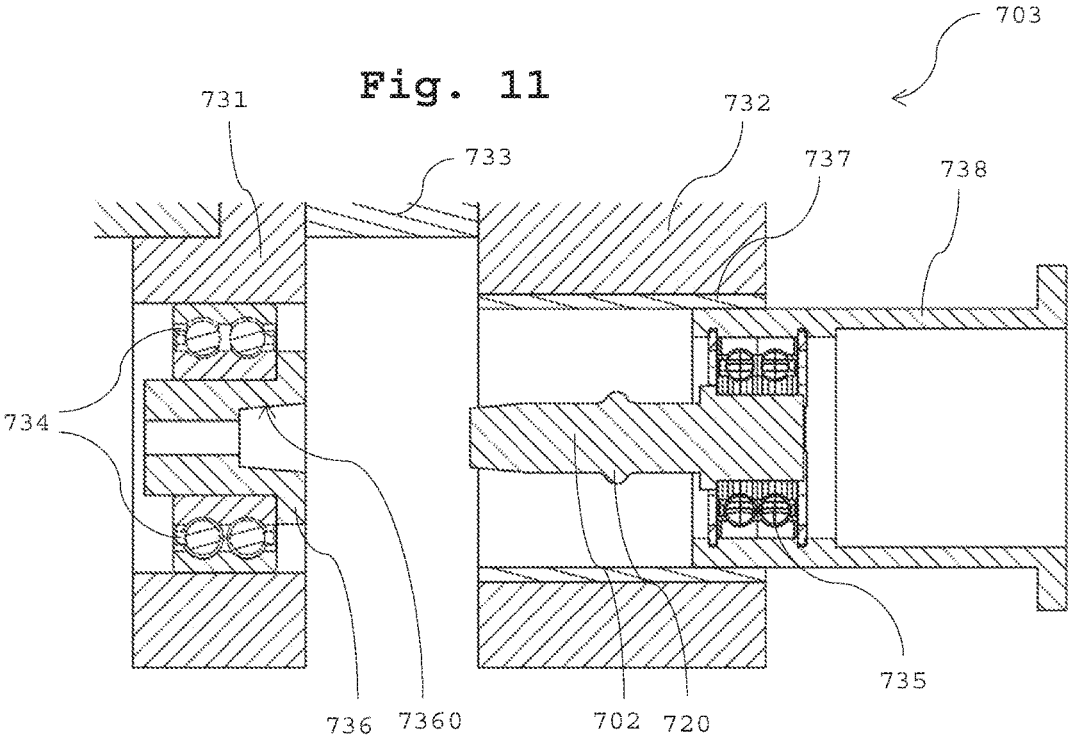
FIG. 11—a third illustrative embodiment of a rotatable mounting of a mandrel with the mandrel pulled out of one mounting side.
Figure 12:
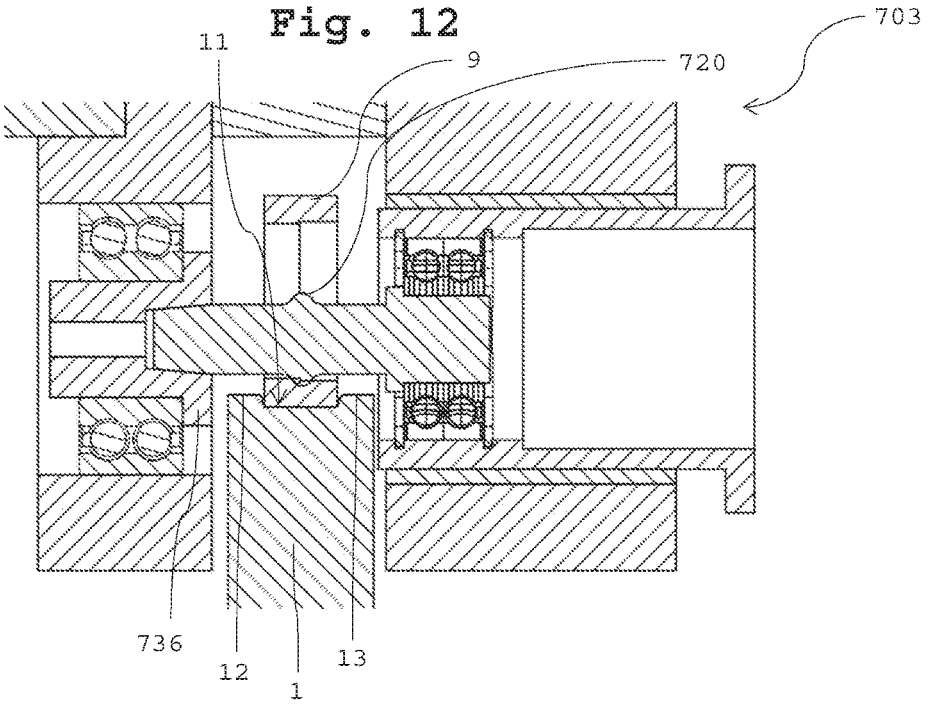
FIG. 12—the mandrel mounting of FIG. 11 with the mandrel rotatably mounted at both sides.

A third illustrative embodiment of a rotatable mounting of a mandrel 702 in a revolver drum 703 is shown in FIGS. 11 and 12. The revolver drum 703 comprises two spaced, disc-like drum parts 731 and 732, which are torsionally rigidly connected to one another via a shaft 733. A stop 736 for the one end of the mandrel 702 is rotatably mounted in the drum part 731 via a rolling bearing 734. The stop 736 comprises an inwardly tapered abutment surface 7360, on which the tapered one end of the mandrel 702 rests when the mandrel 702 is fully retracted into the revolver drum 703 (see FIG. 12). The stop 736 positions the mandrel 702 both in the longitudinal direction and laterally.

The drum part 732 comprises a guide bushing 737, in which a tubular mandrel holder 738 is guided to be movable in the longitudinal direction of the mandrel. The end of the mandrel 702 facing away from the tapered end is rotatably held in the mandrel holder 738 via a rolling bearing 735. The mandrel 702 can be adjusted from the extended position shown in FIG. 11 to the retracted position shown in FIG. 12 and vice versa via the mandrel holder 738.

The advantage of this type of mandrel mounting is that the mandrel 702 is exactly positioned by the stop 736 in both the longitudinal direction and laterally. This is important in particular when the rolling surface 11 of the drive roller 1 and/or the middle part of the mandrel 702 holding the ring blank 9 is shaped and the rolled ring is supposed to comprise a specific profile. In the present case the mandrel 702 comprises a ring bead 720, by means of which the ring blank 9 is provided with an annular groove in the ring rolling process. Thanks to the stop 736, this annular groove is formed in the right place on the ring blank 9.

Apart from the revolver drum 703 and the mandrel 702, the other components of the ring rolling device according to this third illustrative embodiment can be configured substantially as previously described in connection with the first illustrative embodiment. Rather than directly on the mandrel, the mandrel adjuster 4 simply engages on the mandrel holder 738.

Figure 13:
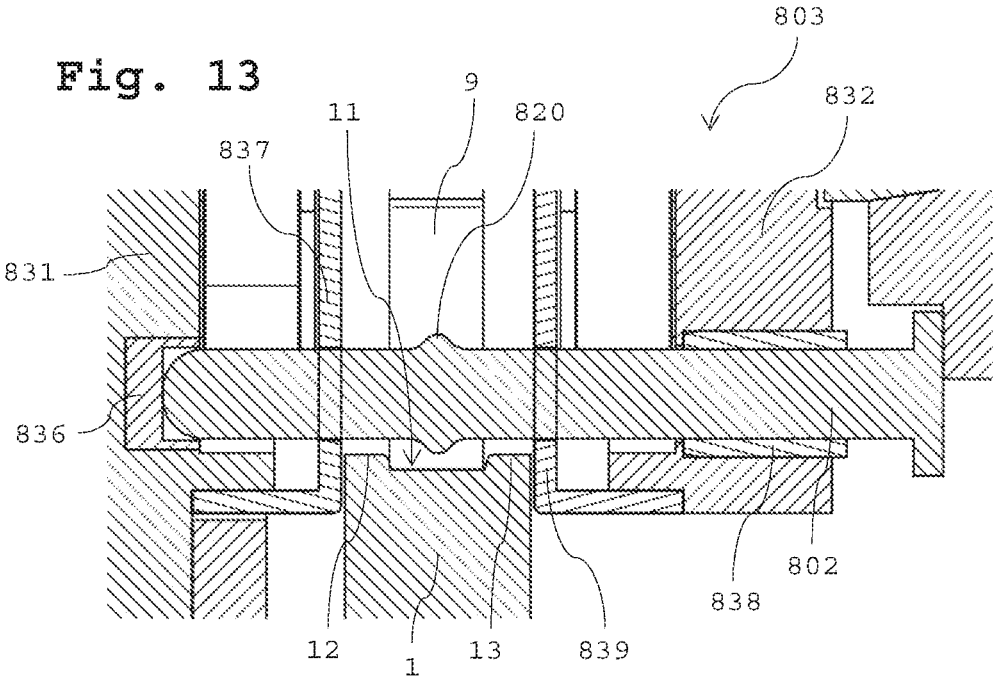
FIG. 13—a fourth illustrative embodiment of a rotatable mounting of a mandrel.

FIG. 13 shows a fourth embodiment of a rotatable mounting of a mandrel 802 in a revolver drum 803. The revolver drum 803 comprises two spaced, disc-like drum parts 831 and 832, which are torsionally rigidly connected to one another via a not shown shaft. A longitudinal stop 836 for one end of the mandrel 802 is fixedly anchored in the drum part 831. The lateral guiding for this end of the mandrel 802 occurs by means of an angled lateral guide element 837 provided with a passage for the mandrel 802.

The drum part 832 comprises a guide bushing 838 and an angled lateral guide element 839 provided with a passage for the mandrel 802.

Also with this type of mandrel mounting the mandrel 802 is exactly positioned in both the longitudinal direction and laterally, which is again important because the mandrel 802 in the present case comprises a ring bead 820, by means of which the ring blank 9 is provided with an annular groove in the ring rolling process.

Apart from the revolver drum 803 and the mandrel 802, the other components of the ring rolling device according to this fourth illustrative embodiment can be configured substantially as previously described in connection with the first illustrative embodiment.

Figure 14:
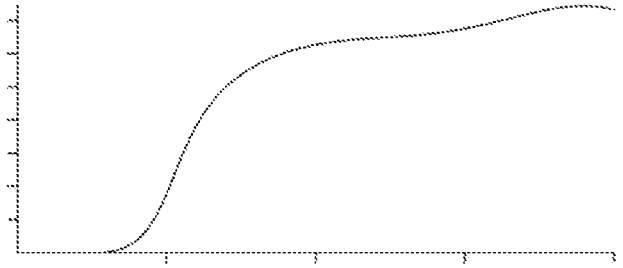
FIG. 14—an exemplary path-time diagram of the rotation of the revolver drum of a ring rolling device according to the invention.
Figure 15:
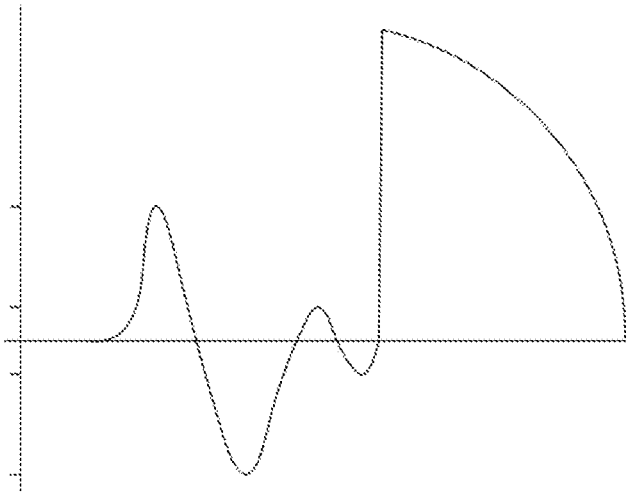
FIG. 15—an exemplary torque-time diagram of the rotation of the revolver drum according to FIG. 14.

FIG. 14 shows an exemplary path-time diagram, and FIG. 15 shows a corresponding exemplary torque-time diagram of the rotation of the revolver drum of a ring rolling device according to the invention.

The two diagrams show that the revolver drum is initially stationary for a certain amount of time. During this time, a ring blank 9 is in the loading position and a mandrel is pushed through the ring blank 9 and inserted into the revolver drum to a possible stop. The revolver drum 3 is then made to rotate and said mandrel with the ring blank 9 mounted around it is rotated toward the drive roller 1. Initially this requires a rapidly increasing starting torque, which then decreases and even becomes negative until the ring blank 9 is roughly prepositioned in front of the drive roller 1. During this time, the revolver drum rotates through a relatively large rotation angle of about 60°. Subsequently there is a precise positioning of the ring blank 9, with first increasing and then decreasing torque, which is carried out much more slowly, i.e. the speed of rotation of the revolver drum is significantly lower. As soon as the ring blank 9 in the roll gap then abuts the drive roller 1 and the actual ring rolling begins, the required torque increases rapidly in a short amount of time. During the ring rolling process itself, the torque continuously decreases again to 0. After that a new cycle begins.

Further variations are possible in addition to the above-described ring rolling devices and all the mentioned features of the device are freely combinable, as long as technically there is no impediment.

For larger ring blanks and correspondingly thick mandrels, the mandrels can only be mounted on one side, for example.

Alternatively, the delivery of the ring blanks to the revolver drum can also be carried out with the aid of pivotable mandrels or mandrels mounted in a conveyor chain.

The invention claimed is:

1. A ring rolling device for enlarging a ring blank, comprising a press element, a rotatably mounted mandrel around which the ring blank can be mounted, and a rotatable revolver drum, in which the mandrel is rotatably mounted, the rotatable revolver drum having a rotation axis, wherein the mandrel can be moved toward and away from the press element by rotating the revolver drum, wherein the revolver drum is disposed relative to the press element such that, by rotating the revolver drum, a decreasing roll gap is formed between the mandrel and the press element, in which the ring blank is rolled during rotation of the revolver drum, wherein the revolver drum comprises at least two rotatably mounted support rollers for the rotatable mounting of the mandrel, wherein the support rollers and insert are located at a position intermediate to the mandrel and the rotation axis of the revolver drum and support the mandrel in the direction of the rotation axis of the revolver drum, so that the mandrel is situated between the support rollers and the press element during the rolling process.

2. The ring rolling device according to claim 1, wherein the revolver drum comprises two spaced drum parts, which are torsionally rigidly connected to one another and in each of which a part of the mandrel is rotatably mounted, so that a middle part of the mandrel between the two drum parts is exposed for mounting the ring blank.

3. The ring rolling device according to claim 2, wherein each drum part comprises at least two rotatably mounted support rollers for the rotatable mounting of the mandrel.

4. The ring rolling device according to claim 2, wherein each support roller comprises a support flange for supporting the mandrel.

5. The ring rolling device according to claim 2, wherein the mandrel in the revolver drum is rotatably mounted in at least one rolling bearing.

6. The ring rolling device according to claim 2, wherein the revolver drum comprises a stop for positioning the mandrel in the longitudinal direction of the mandrel.

7. The ring rolling device according to claim 2, wherein the ring rolling device comprises a mandrel adjuster for adjusting the mandrel in the longitudinal direction of the mandrel.

8. The ring rolling device according to claim 2, wherein the ring rolling device comprises a ring blank feed mechanism, with which ring blanks can be fed individually to a location in which the mandrel can be pushed through the fed ring blank.

9. The ring rolling device according to claim 2, wherein additional mandrels are rotatably mounted in the revolver drum.

10. The ring rolling device according to claim 1, wherein each support roller comprises a support flange for supporting the mandrel.

11. The ring rolling device according to claim 10, wherein the support flanges are respectively disposed at one end of the support rollers and serve as lateral guides for the ring blank.

12. The ring rolling device according to claim 1, wherein the mandrel in the revolver drum is rotatably mounted in at least one rolling bearing.

13. The ring rolling device according to claim 1, wherein the mandrel is only mounted on one side.

14. The ring rolling device according to claim 1, wherein the revolver drum comprises a stop for positioning the mandrel in the longitudinal direction of the mandrel.

15. The ring rolling device according to claim 1, wherein the ring rolling device comprises a mandrel adjuster for adjusting the mandrel in the longitudinal direction of the mandrel.

16. The ring rolling device according to claim 1, wherein the ring rolling device comprises a ring blank feed mechanism, with which ring blanks can be fed individually to a location in which the mandrel can be pushed through the fed ring blank.

17. The ring rolling device according to claim 1, wherein additional mandrels are rotatably mounted in the revolver drum.

18. The ring rolling device according to claim 1, wherein the ring rolling device comprises a drive mechanism for driving the press element, so that the ring blank can be rotated by the movement of the press element during the rolling process.

19. The ring rolling device according to claim 1, wherein the press element is a rotatably mounted drive roller.

* * * * *